US006679559B2

(12) United States Patent
Kelm

(10) Patent No.: US 6,679,559 B2
(45) Date of Patent: Jan. 20, 2004

(54) AUGER FLIGHT SUPPORT FOR PLURAL AUGER COAL MINING SYSTEMS

(76) Inventor: Warren E. Kelm, 38 Shoshone Trail, Malvern, OH (US) 44644

( * ) Notice: Subject to any disclaimer, the term of this patent is extended or adjusted under 35 U.S.C. 154(b) by 0 days.

(21) Appl. No.: 10/074,412

(22) Filed: Feb. 12, 2002

(65) Prior Publication Data

US 2003/0150648 A1 Aug. 14, 2003

(51) Int. Cl.[7] ..... E21C 27/22; E21B 10/44

(52) U.S. Cl. ..... 299/57; 299/87.1; 175/323; 175/325.3; 175/91; 198/666; 198/672

(58) Field of Search ..... 299/87.1, 55, 56, 299/57, 30, 68; 175/323, 325.3, 325.2, 91, 394, 408; 384/29, 15; 198/666, 672

(56) References Cited

U.S. PATENT DOCUMENTS

| | | | | | |
|---|---|---|---|---|---|
| 693,801 | A | | 2/1902 | Leaverton | |
| 1,086,748 | A | | 2/1914 | Braasch | |
| 1,729,211 | A | | 9/1929 | Erisman | |
| 2,298,332 | A | | 10/1942 | Applegate | |
| 2,709,572 | A | | 5/1955 | Ageborn | |
| 2,751,203 | A | | 6/1956 | Compton | |
| 2,783,974 | A | | 3/1957 | Veasman | |
| 2,839,271 | A | | 6/1958 | Kandle | |
| RE24,503 | E | * | 7/1958 | Compton | 299/87.1 |
| 2,887,300 | A | | 5/1959 | Meredith | |
| 2,940,740 | A | * | 6/1960 | Adams | 299/57 |
| 3,012,371 | A | | 12/1961 | Pawela | |
| 3,036,821 | A | * | 5/1962 | Letts | 299/55 |
| 3,083,955 | A | * | 4/1963 | Compton | 299/56 |
| 3,191,753 | A | * | 6/1965 | Kirkpatrick | 198/550.1 |
| 3,278,001 | A | * | 10/1966 | Andrews | 198/672 |
| 3,319,771 | A | * | 5/1967 | Nesseth | 198/583 |
| 3,327,840 | A | * | 6/1967 | Wilkes | 198/672 |
| 3,796,448 | A | * | 3/1974 | Ringkamp | 285/317 |
| 3,830,318 | A | | 8/1974 | Busby et al. | |
| 3,856,357 | A | * | 12/1974 | Wharton | 299/12 |
| 3,912,025 | A | * | 10/1975 | Deeter et al. | 175/91 |
| 3,980,342 | A | * | 9/1976 | Dunham | 299/56 |
| 3,987,561 | A | * | 10/1976 | Gee et al. | 37/420 |
| 4,015,674 | A | * | 4/1977 | Hawthorne et al. | 175/91 |
| 4,036,529 | A | * | 7/1977 | Hawthorne et al. | 299/19 |
| 4,074,778 | A | * | 2/1978 | Morrell et al. | 175/91 |
| 4,159,149 | A | | 6/1979 | Castanoli et al. | 299/80 |
| 4,220,242 | A | * | 9/1980 | Forsberg | 198/666 |
| 4,364,469 | A | | 12/1982 | Rudolph | 198/616 |
| 4,440,539 | A | * | 4/1984 | Sullivan | 414/300 |
| 5,087,101 | A | * | 2/1992 | Justice et al. | 299/18 |
| 5,318,444 | A | | 6/1994 | Kuzub et al. | 414/326 |
| 5,358,062 | A | | 10/1994 | Uhl et al. | 175/394 |
| 5,496,095 | A | * | 3/1996 | Scholl | 299/57 |
| 5,685,382 | A | | 11/1997 | Deeter | 175/394 |
| 6,206,177 | B1 | * | 3/2001 | Broten | 198/672 |

* cited by examiner

*Primary Examiner*—David Bagnell
*Assistant Examiner*—Shane Bomar
(74) *Attorney, Agent, or Firm*—Sand & Sebolt

(57) ABSTRACT

An auger flight support for use with an augering systems for mining which bores a pair of side-by-side holes through the coal seam using respective augers. Each auger includes a drilling section which is followed by a series of auger flights for conveying the bored coal back out of the respective hole. The auger flight support includes a pair of thrust bearing and housing assemblies which are tied together and each supported by a respective leg which lowers the friction between the auger flight and the bottom of the bore. This significantly reduces the power required to rotate the augers.

20 Claims, 6 Drawing Sheets

AUGER FLIGHT SUPPORT FOR PLURAL AUGER COAL MINING SYSTEMS

BACKGROUND OF THE INVENTION

1. Technical Field

The present invention relates generally to augering systems which remove coal from seams within a hill by boring long horizontally extending holes into the coal seam using an auger comprising a rotary cutting head and a string of auger flights to convey the cut coal from the coal seam, and more particularly to auger flight supports for reducing boring friction to extend the distance the auger system can bore into the hill.

2. Background Information

Augering machines powered by internal combustion engines have been used for mining coal from hills containing a coal seam for many years. These augering machines utilize an auger having a cutting head which is advanced horizontally into the coal seam. The auger is usually made up of a series of sections or auger flights having a helically wound flighting, which removably couple together end-to-end to convey the cut coal from the cutting head to a point of discharge outside the hill. The auger flights are rotationally and axially coupled by having a socket at one end and a mating shank on the opposite end. The shank of one auger flight fits into the socket of the next auger flight. A slidable latch pin extends transversely through a hole in the auger flight and into a hole in the shank of the auger flight to be coupled thereto. A release lever permits uncoupling of the auger flights such as when the cutting head is being withdrawn from the bored hole at the completion of the boring. As the string of auger flights is withdrawn, the auger flights are sequentially removed from the auger string by uncoupling and lifting the rearmost auger flight from the auger machine. Pairs of side-by-side cutting heads and augers have been used recently to form a pair of parallel holes in the coal seam to remove a larger volume of coal at once. Each auger is powered by an auger machine which applies axial as well as rotational forces to the augers to force the augers and the cutting heads into the coal seam and to rotate the cutting heads breaking away the material which the augers then convey out of the hole.

There is considerable friction developed between the flighting of the auger flights and the bored holes which requires considerable power from the augering machine, and which reduces the power available to the cutting heads and to convey the cut coal. Attempts have been made to reduce such frictional power losses in auger systems. For example, in U.S. Pat. No. 3,036,821 issued to H. D. Letts is disclosed a spider device where bearings are attached between each of the linearly extending augers, and a plurality of legs are attached to the bearings to form a "spider". The spider somewhat supports the flighting on the bottom of the bored hole so that the flighting does not rub the ground as hard when rotating, thus reducing the power requirements of the auger machine. In U.S. Pat. No. 5,685,382 issued to Deeter is disclosed a similar auger support having a plurality of radially extending support legs affixed a bearing housing surrounding a bearing. The drive shank of an auger flight is rotatably supported by the bearing at one end of an auger flight, independently of the support provided by the auger flighting, to reduce wear and tear of the flighting and to reduce frictional drag of the auger flights. Finally, in U.S. Pat. No. Re 24,503 to C. E. Compton, which was originally U.S. Pat. No. 2,751,203 is disclosed a spider-type support system for an auger mining system. All of these devices, however, fail to solve a number of problems associated therewith.

There is thus, a continuing need for a support device which overcomes a number of problems associated with the prior art.

SUMMARY OF INVENTION

One of the advantages of the present invention is that it provides reduced frictional losses between the flighting and the bottom of the bored holes resulting in less power required to bore a given length hole.

A further advantage of the present invention is that it permits longer holes to be bored using the same augering machine due to the reduced friction.

A still further advantage of the present invention is that it is used for dual auger boring.

These and other advantages of the present invention may be realized by reference to the remaining portions of the specification, claims, and abstract.

BRIEF SUMMARY OF THE INVENTION

The present invention relates to an auger flight support for unitizing and supporting pairs of auger flights by connecting together respective first ends of each pair of parallel tubular auger flights. The auger flights each include a respective helical flighting affixed exteriorly therearound having a respective outer diameter, and include respective second ends having a drive socket. The unitized auger flights are adapted for use with an augering apparatus of the type used for rotating and advancing a pair of side-by-side cutting heads of a drilling section. The drilling section is driven horizontally into the side of a hill with the cutting heads driven rotationally through the drive sockets by the augering apparatus. The unitized auger flights are inserted between the drilling section and the augering apparatus in a rotationally coupled end-to-end manner as drilling progresses. The auger flight support includes a pair of support posts, each having a tubular bearing housing and a radially dependent support leg. A pair of drive shafts each includes a first end adapted to closely fit within and be affixable to the first end portion of a respective flight auger, a second end portion of mating configuration to the drive sockets, and a middle bearing portion which fits within said bearing housing. At least one bearing is disposed within each of the bearing housings between the respective bearing housing and the bearing portion of the respective drive shaft which bearing rotationally supports and longitudinally retains the respective drive shaft to the respective support post. A tie bar is adapted to rigidly interconnect the support posts at such a spacing that the respective of the outer boring diameters of the flightings which are closely adjacent one another. The support legs extend generally downwardly and coplanar so as to provide support for the auger flights.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE SEVERAL VIEWS OF THE DRAWINGS

Preferred embodiments of the present invention are shown in the accompanying drawings wherein.

DETAILED DESCRIPTION OF THE INVENTION

Figure 1:
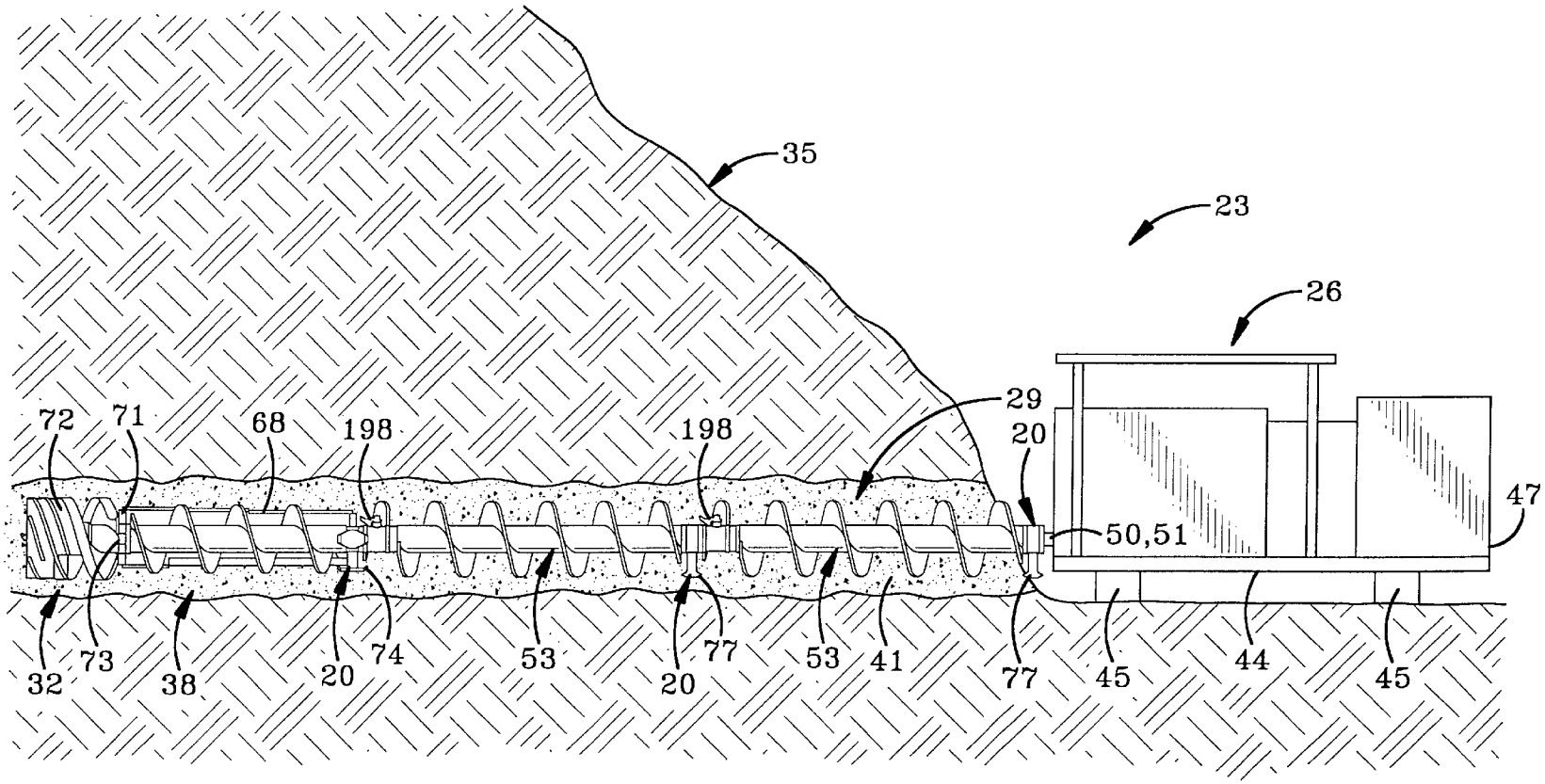
FIG. 1 is a vertical cross-sectional view of a hill showing an augering machine positioned adjacent the side of the hill outside the hillside during drilling horizontally into a coal seam using an illustrative embodiment of auger flights and support assemblies according to the present invention.

Referring to FIG. 1, there is shown a plurality of auger flight supports 20 illustrative of the invention, as used with a conventional dual auger drilling system 23 which includes an augering machine 26 that drives a plurality of unitized flight sections 29 and a unitized drilling section 32. The drilling system 23 is used for drilling into a hill 35 that contains a generally horizontally disposed coal seam 38, and to remove the resulting cut coal chunks 41.

The augering machine 26 is of conventional design for providing rotational power through the flight sections 29 to the drilling section 32. One such machine is the MC-DK Coal Recovery Auger, manufactured by the Salem Tool Company of London, Ky. The augering machine 26 includes a main frame 44 supported on a plurality of downwardly dependent legs 45. A wheeled carriage 47 which is hydraulically driven to force the flight sections 29 and the drilling section 32 into and from the hill 35 travels longitudinally on the main frame 44 on a pair of parallel rails (not shown) of the main frame. An internal combustion engine (not shown) is mounted on the carriage 47 which drives the flight sections 29 and the drilling section 32 through a pair of power trains (not shown) each of which includes a clutch, a flexible coupling, and a shiftable transmission. The power is output through a pair of power outputs 50 and 51. Similarly, a triple could be provided having a rotating auger above the above-described pair of augers.

Each of the unitized flight sections 29 comprises a pair of auger flights 53 each having an elongate tubular body 56 to which is affixed a respective external helical flighting 59. Within a forward portion 62 of the tubular body 56 is affixed a socket insert (not shown) having a drive socket of square cross-sectional configuration adapted to slidably and non-rotatably fit a mating drive shank (not shown) on an axially adjacent auger flight 53 as is known in the industry. Therefore, adjacent pairs of axially aligned auger flights 53 may be rotationally interconnected and axially coupled to one another end-to-end by inserting the mating shank of one auger flight 53 into the mating socket of the axially aligned auger flight 53 to secure transmission of rotational torque and axial drilling force from one to the other. Respective rearward portions 65 of the tubular bodies 56 are held together in a spaced relationship by an auger flight support 20 as will be explained subsequently.

The drilling section 29 comprises a pair of the auger flights 53 which are journaled to an elongate T-shaped center frame 68 at a front bearing support bracket 71 thereof. A pair of boring or drilling heads 72 each includes a square shank (not shown) which fits through a pair of thrust bearings 73 in support bracket 71. The square shanks fit into the drive socket of the tubular body 56 so as to be rotationally affixed to the respective auger flights 53 of the drilling section 29 to bore into the coal seam 38. Therefore, the adjacent axially aligned auger flights 53 of the unitized flight section 29 may be rotationally interconnected and axially coupled to one another end-to-end by inserting a mating shank of one auger flight 53 into the mating socket of the axially adjacent auger flight 53 to secure transmission of rotational torque and axial drilling force from one to the other. The respective rear portions 65 of the tubular bodies 56 are held together in a spaced relationship by an auger flight support 20 adjacent a plow plate 74 of the center frame 68 (FIG. 1).

Figure 2A:
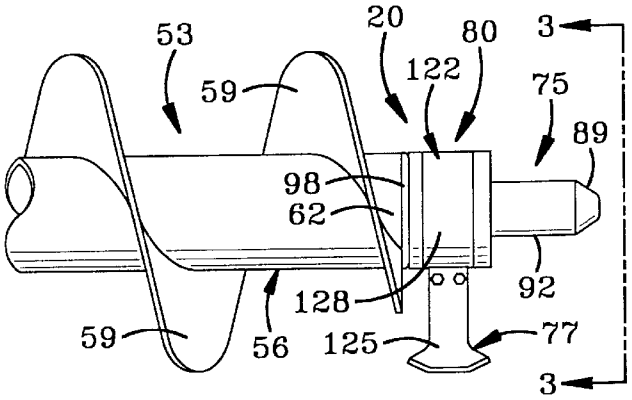
FIG. 2A, a fragmentary side elevational view corresponding to FIG. 2, but with the auger flight and the support assembly assembled together.
Figure 2:
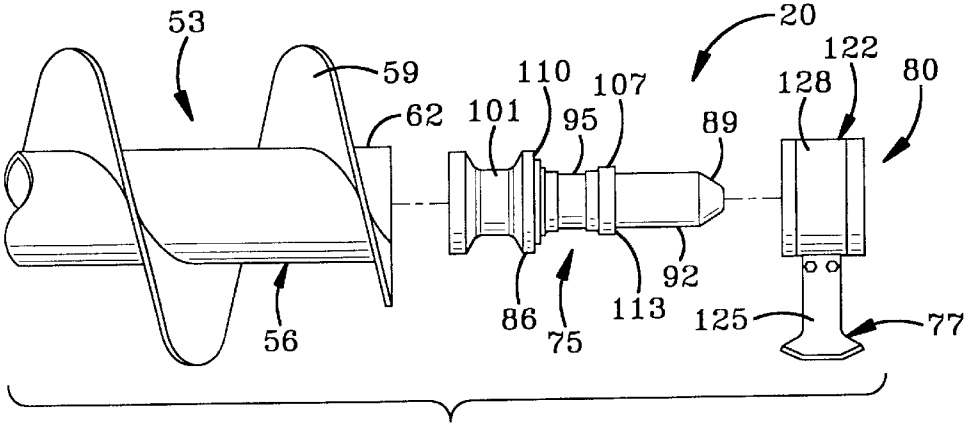
FIG. 2, a fragmentary exploded side elevational view of an auger flight and a support assembly.
Figure 5:
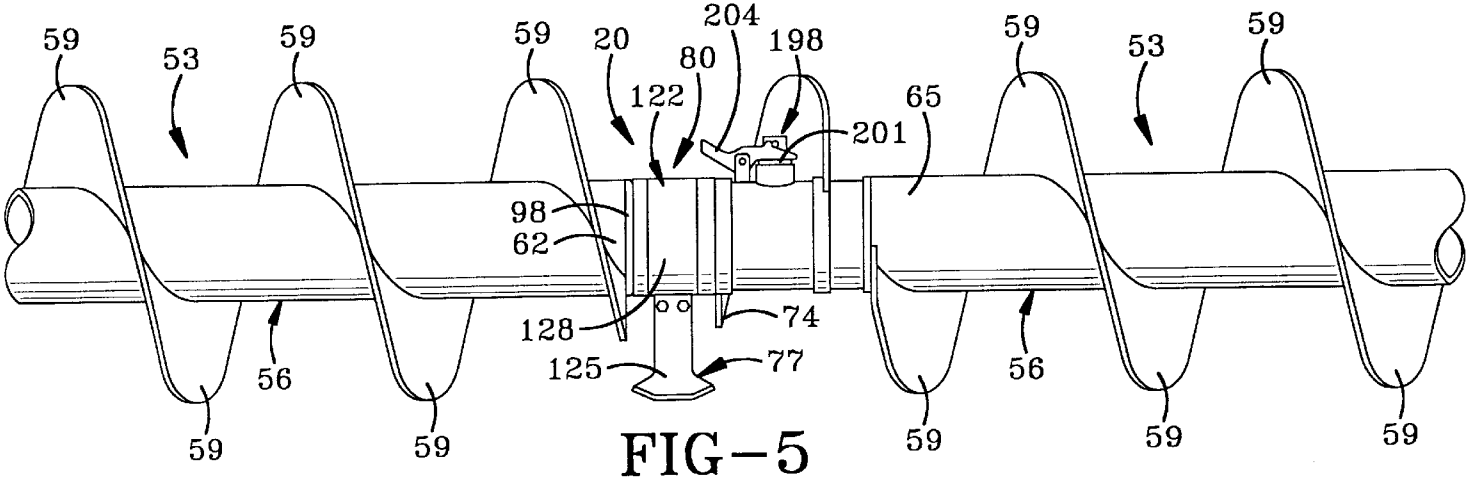
FIG. 5, a fragmentary side elevational view of a pair of auger flights connected together and supported by a support assembly.
Figure 3:
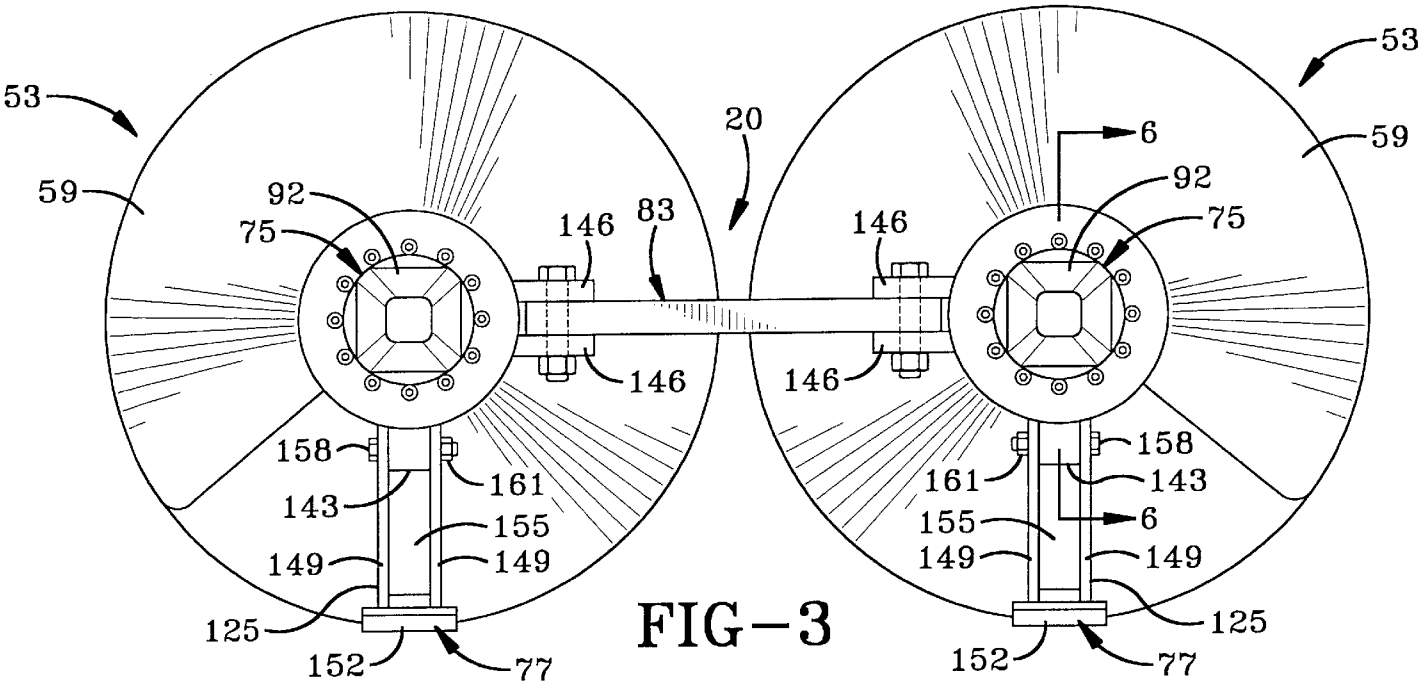
FIG. 3, a lateral vertical sectional view taken on the line 3—3 of FIG. 2A showing a pair of auger flights connected together side-by-side using the bar.
Figure 4:
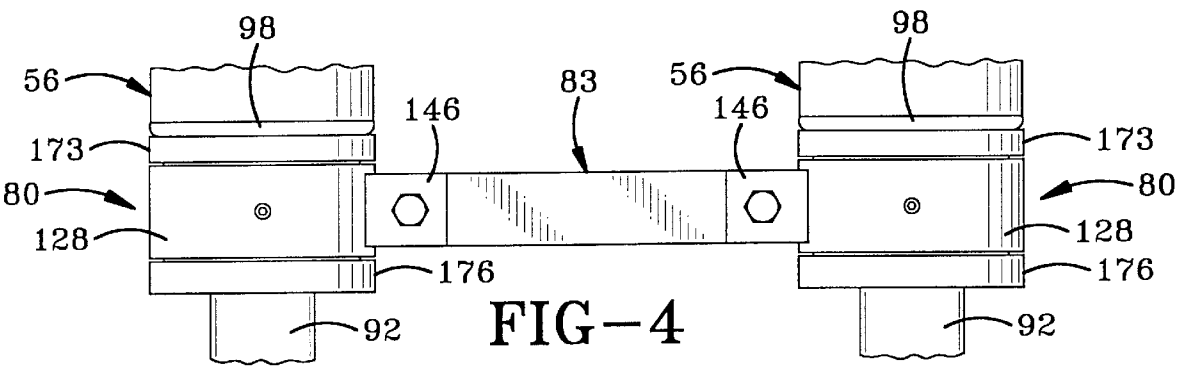
FIG. 4, a fragmentary top plan view of the ends of the auger flights connected together using the tie bar.
Figure 6:
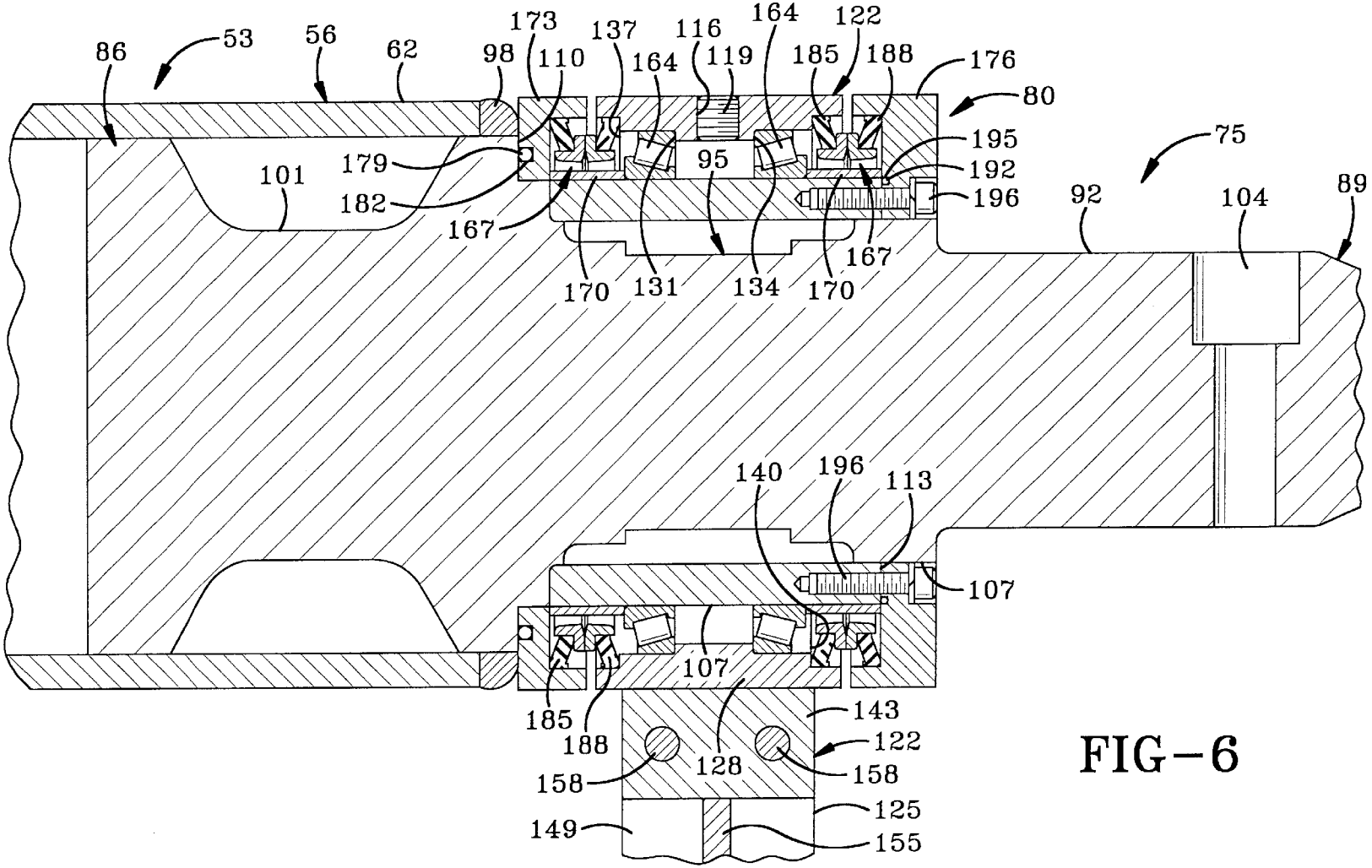
FIG. 6, a fragmentary longitudinal vertical sectional view to an enlarged scale of the auger flight and the support assembly.
Figure 6A:
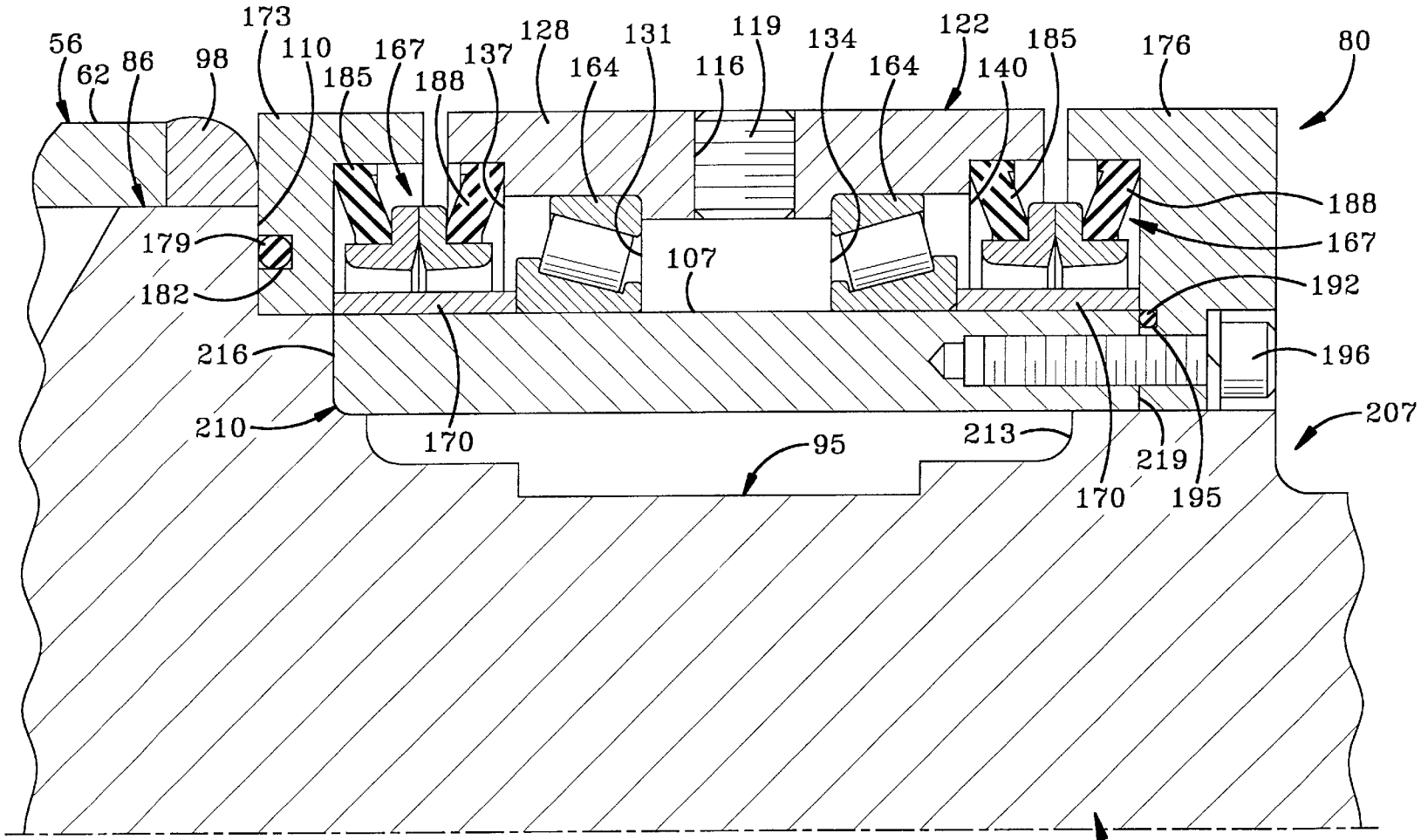
FIG. 6A, a fragmentary longitudinal vertical sectional view corresponding to FIG. 6 to a further enlarged scale showing the details of the bearing assembly, and FIG. 7, a fragmentary vertical cross-sectional view corresponding to FIG. 1 but with an additional auger flight added to increase the depth of boring.
Figure 7:
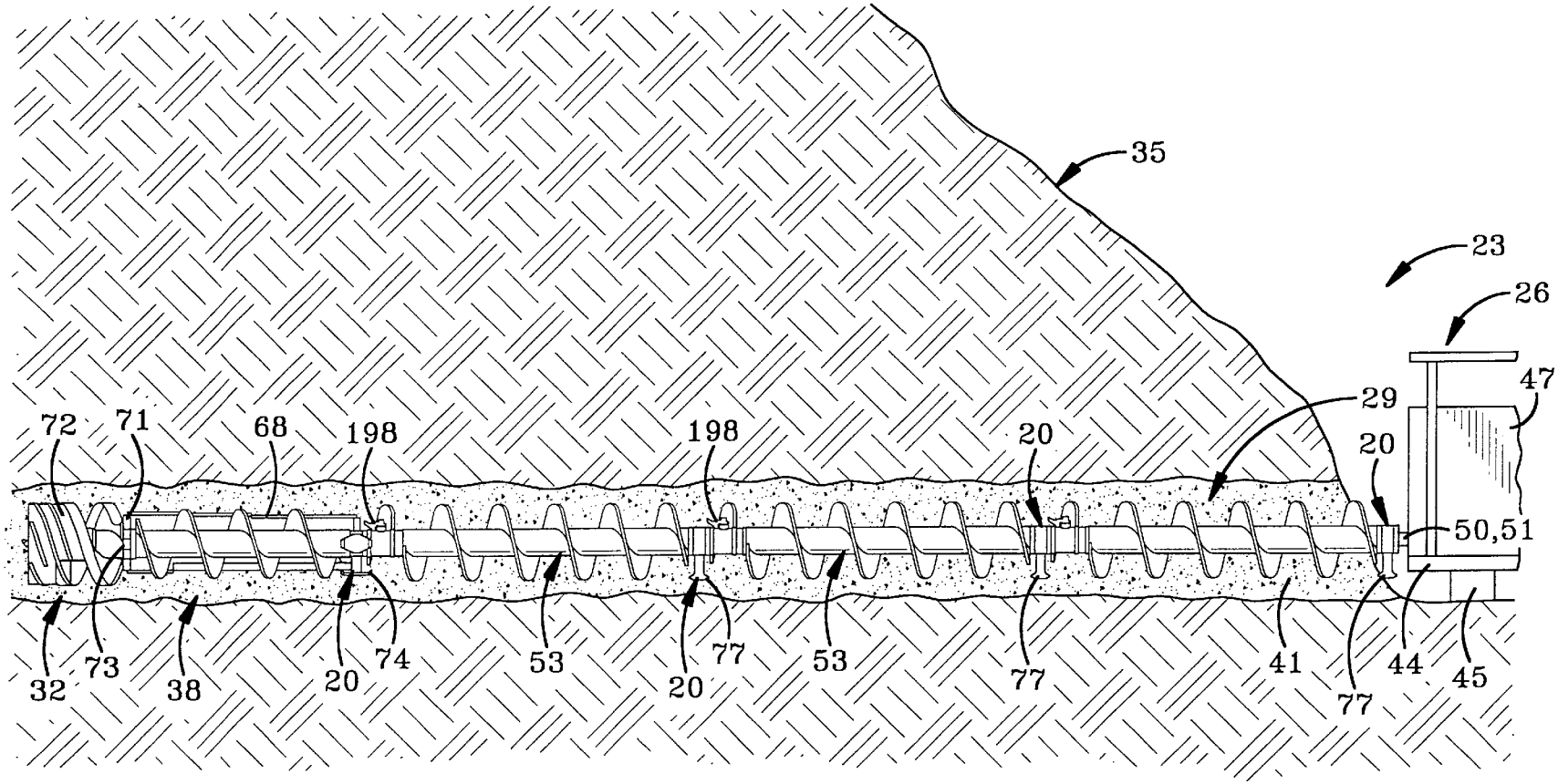

Referring to FIGS. 2–3, auger flight supports 20 comprise a pair of drive shafts 75, which are each supported on a support post 77 containing a bearing assembly 80, and connected together by a tie bar 83 (FIG. 3). The drive shafts 75 include a first end portion 86 adapted to closely fit within and be affixable to the rear portion 65 of a respective tubular body 56. A second end portion 89 of the drive shafts 75 include a square drive shank 92 of mating configuration to the drive sockets. A middle bearing portion 95 is located between the respective first and second end portions 86 and 89. The first end portion 86 is affixed to the rear portion 65 of the tubular body 56 of a respective auger flight 53 at an annular weld 98. The first end portion 86 includes an annular recess 101 for reducing the weight of the drive shaft 75. Referring to FIGS. 6–6A, lock pin hole 104 extends through the drive shank 92 for axially coupling the respective auger flights 53 as will be explained subsequently. The middle bearing portion 95 includes an annular bearing support surface 107 of reduced outer diameter, which abuts the first end portion 86 of the drive shaft 75 at a shoulder 110. The bearing support surface 107 also abuts the second end portion 89 of the drive shaft 75 at a shoulder 113 of further reduced diameter. A threaded lubrication hole 116 is closable using a removable threaded plug 119 which threads thereinto.

The support posts 77 each include a tubular bearing housing 122 and a downwardly dependent support leg 125. The bearing housing 122 includes a tube 128 having a pair of inner shoulders 131 and 134, and a pair of outer shoulders 137 and 140. A downwardly dependent leg mounting block 143 and a pair of laterally inwardly dependent tabs 146 extend from the tube 128. The support leg 125 includes a pair of upright side plates 149 which extend vertically from an upwardly bent foot plate 152. The side plates 149 are interconnected by a front plate 155. The respective support legs 125 bolt to the respective leg mounting blocks 143 using respective bolts 158 and locknuts 161.

The bearing assemblies 80 each include a pair of annular roller thrust bearings 164, a pair of seals 167, a pair of thin spacer sleeves 170, an annular forward flange ring 173, and an annular rear flange ring 176. The flange ring 173 closely fits about the bearing support surface 107 of the drive shaft 75 and includes an O-ring 179 disposed in an O-ring groove 182 which seals against the shoulder 110. The respective thrust bearings 164 closely fit about the bearing support surface 107 of the drive shaft 75, disposed against the respective inner shoulders 131 and 134 of the tube 128. The spacer sleeves 170 closely fit about the bearing support surface 107 of the drive shaft 75 abutting the respective thrust bearings 164 to maintain the proper spacing for the seals 167. The seals 167 include respective mating halves 185 and 188 which are respectively pressfit within the forward flange ring 173 and the rear flange ring 176, and against the respective outer shoulders 137 and 140 of the tube 128. The mating halves 185 and 188 abut to seal out dirt and fluids from reaching the respective thrust bearings 164. The flange ring 176 closely fits about the second end portion 89 at a shoulder 113 of the drive shaft 75 and includes an O-ring 192 disposed in an O-ring groove 195 which seals against the shoulder 113.

The respective drive shafts 75, the support posts 77, and the bearing assemblies 80 are held together by a plurality of bolts 196 which extend through the flange ring 176 and which longitudinally thread into the shoulder 113 of the drive shaft 75. Alternatively, the drive shaft 75 can be externally threaded at the shoulder 113 and the rear flange ring 176 internally threaded so as to threadably engage to retain the respective drive shafts 75, the support posts 77, and the bearing assemblies 80. The support posts are connected together using the tie bar 83 which bolts to the respective pairs of laterally dependent tabs 146 of the bearing housings 122. The respective auger flights are axially coupled together using a locking pin assembly 198 as is known in the industry, which includes an inwardly biased, spring loaded pin 201 which engages the lock pin hole 104 through the drive shank 92, and a release lever 204 which is pivotally connected to the forward portion 62 of the auger flights 53. Depressing the release lever 204 pulls the pin 201 radially outwardly against the spring biasing to permit coupling and uncoupling of axially adjacent auger flights 53. A longitudinal frame member (not shown) which is disposed between the auger flights 53 can be bolted between the axially adjacent tie bars 33 for additional support.

Operationally, it can be seen that support post 77, when positioned along the axially aligned coupled auger flights, will support the weight of the auger flights and the material being transmitted rearwardly along the flights toward the drilling machine. Additionally, support post 77, by way of bearing assembly 80, will allow for the smooth rotation of the auger flights, substantially reducing drag and friction, allowing more energy to be transmitted to drilling head 72. In this manner, the coal may be removed from coal seam 38 within hill 35 quicker and with less energy. Additionally, a significantly longer hole may be drilled into hill 35 along coal seam 38 allowing for more coal to be removed than was otherwise possible before the use of the present invention.

Additionally, this device could be used on an auger drilling system 23 which drives three unitized flight sections without departing from the spirit of the present invention.

It can now be seen that the present invention solves many of the problems associated with the prior art. The present invention provides reduced frictional losses between the flighting and the bottom of the bored holes resulting in less power required to bore a given length hole. The present invention also allows longer holes to be bored using the same augering machine due to the reduced friction. The present invention provides for dual auger boring.

Although the description above contains many specifications, these should not be construed as limiting the scope of the invention but as merely providing illustrations of some of presently preferred embodiments of this invention. The specification, for instance, makes reference to dual auger boring. However, the present invention is not intended to be limited to use only with dual augers. Rather it is intended that the present invention can be easily adapted for use with three or more side-by-side augers by adding more pairs of tabs and additional tie bars, or even by adding augers which are vertically disposed. Thus, the scope of the invention should be determined by the appended claims and their legal equivalents rather than by the examples given.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. An auger flight support for supporting a plurality of auger flights by connecting together respective first ends of parallel auger flights, the auger flights each having a respective helical flighting affixed exteriorly therearound and having a respective outer diameter and respective second ends having a drive socket, the auger flights being adapted for use with an augering apparatus of the type used for rotating and advancing a plurality of side-by-side cutting heads of a drilling section, the drilling section which is driven horizontally into the side of a hill with the cutting heads driven rotationally through the drive sockets by the augering apparatus, the unitized auger flights being inserted between the drilling section and the augering apparatus in a rotationally coupled end-to-end manner as drilling progresses, the auger flight support comprising:

a pair of support posts, each having a tubular bearing housing and a radially dependent support leg;

a pair of drive shafts each having a first end adapted to closely fit within and be affixable to the first end of a respective flight auger, a second end of mating configuration to the drive sockets adapted to be axially retained therein to axially and rotationally secure together axially adjoining auger flights, and a middle bearing portion which fits within said bearing housing;

at least one bearing disposed within each of said bearing housings between the respective bearing housing and said bearing portion of the respective said drive shaft, said at least one bearing which rotationally supports and longitudinally retains the respective drive shaft to the respective support post; and a tie bar adapted to rigidly removably interconnect said bearing housings at such a spacing that the respective of said outer boring diameters of said flightings are closely adjacent one another, and said support legs extend generally downwardly and are of such a length that an endmost portion thereof extends radially beyond the outer diameter of the flighting to provide support for the auger flights.

2. The auger flight support of claim 1, wherein there are a pair of thrust bearings for each bearing housing which absorb axial thrust of the drive shafts in opposite longitudinal directions.

3. The auger flight support of claim 2, further comprising a pair of seals coaxially adjacent opposite sides of the thrust bearings for preventing contaminants from reaching said thrust bearings.

4. The auger flight support of claim 1, wherein the endmost portion of the support legs comprise respective plates which are generally horizontally disposed and which curve upwardly at respective ends which are in a direction longitudinal of the auger flights.

5. The auger flight support of claim 1, wherein the support legs are substantially parallel in an assembled position to the flight augers.

6. The auger flight support of claim 1, wherein the tie bar comprises an elongate bar of flattened cross-section, which rigidly interconnects the support posts with respective laterally long sides thereof disposed in a substantially horizontal position.

7. The auger flight support of claim 1, wherein the endmost portion of the respective support legs comprise a support foot.

8. The auger flight support of claim 1, wherein the support legs are removably connected to the bearing housing.

9. The auger flight support of claim 1, wherein the second end of the drive shafts are of square cross-section for mating with drive sockets of square cross-section.

10. The auger flight support of claim 1, wherein the drive shafts are adapted to be axially retained in the drive sockets by including a hole which extends at least part way through the second end of said drive shaft adapted to engage a locking pin of a conventional locking pin assembly of an axially adjoining flight auger to secure together said flight augers.

11. The auger flight support of claim 1, further comprising a pair of seals coaxially adjacent opposite sides of the bearings for preventing contaminates from reaching said bearings.

12. The auger flight support of claim 1, further comprising a longitudinal frame member disposed between the auger flights and adapted to rigidly removably interconnect axially adjacent tie bars to provide additional support thereto.

13. The auger flight support of claim 12, wherein there are a pair of thrust bearings for each bearing housing which absorb axial thrust of the drive shafts in opposite longitudinal directions, and further comprising a pair of seals coaxially adjacent opposite sides of said thrust bearings for preventing contaminates from reaching said thrust bearings.

14. The auger flight support of claim 12, wherein the tie bar is bolted to the bearing housings, and the longitudinal frame member bolts to axially adjacent tie bars.

15. An auger flight support, for supporting a plurality of auger flights by connecting together respective first ends of parallel auger flights, the auger flights each having a respective helical flighting affixed exteriorly therearound and having a respective outer diameter and respective second ends having a drive socket, the auger flights being adapted for use with an augering apparatus of the type used for rotating and advancing a plurality of side-by-side cutting heads of a drilling section, the drilling section which is driven horizontally into the side of a hill with the cutting heads driven rotationally through the drive sockets by the augering apparatus, the unitized auger flights being inserted between the drilling section and the augering apparatus in a rotationally coupled end-to-end manner as drilling progresses, the auger flight support comprising:

a pair of support posts, each having a bearing housing and a radially dependent support leg;

a pair of drive shafts each having a first end adapted to closely fit within and be affixable to the first end portion of a respective flight auger, a second end portion of mating configuration to the drive sockets, and a middle bearing portion which fits within said bearing housing;

at least one bearing disposed within each of said bearing housings between the respective bearing housing and said bearing portion of the respective said drive shaft, said at least one bearing which rotationally supports and longitudinally retains the respective drive shaft to the respective support post, said at least one bearings comprising pairs of thrust bearings which absorb axial thrust in opposite longitudinal directions;

a tie bar adapted to rigidly interconnect said support Posts at such a spacing that the respective of said outer boring diameters of said flightings are closely adjacent one another, and said support legs extend generally downwardly to provide support for the auger flights; and a pair of seals coaxially adjacent opposite sides of said thrust bearings for Preventing contaminates from reaching said thrust bearings, wherein said seals each comprise respective inner and outer annular seal members, and further comprising respective pairs of annular front and rear flange members, one of said flange members being disposed on each axially opposite side of said thrust bearings for rotation with said drive shaft, said inner annular seal members being affixed to said bearing housing and said outer annular seal members being affixed to said respective annular flange members for rotation with said drive shaft.

16. The auger flight support of claim 15, wherein the rear flange member is bolted to the drive shaft.

17. The auger flight support of claim 15, wherein the front flange member is bolted to a sleeve of the middle bearing portion of the drive shaft.

18. The auger flight support of claim 15, wherein the seals each include respective mating halves which are respectively pressfit within the forward flange ring and the rear flange ring, and against respective outer shoulders of the bearing housings, said mating halves being adapted to abut to seal out dirt and fluids from reaching the bearings.

19. The auger flight support of claim 15, wherein the bearing housings each include a lubrication hole which is closeable using a removable plug.

20. The auger flight support of claim 15, wherein the flange rings each include an O-ring adapted to be disposed in an O-ring groove thereof which seals against the drive shaft.

* * * * *